US009309844B2

(12) United States Patent
McLain

(10) Patent No.: US 9,309,844 B2
(45) Date of Patent: Apr. 12, 2016

(54) COMPONENT OF A FUEL SYSTEM, FUEL SYSTEM AND METHOD FOR OPERATING THE SAME

(71) Applicant: ALTe Powertrain Technologies, Inc., Auburn Hills, MI (US)

(72) Inventor: Kurt D. McLain, Clarkston, MI (US)

( * ) Notice: Subject to any disclaimer, the term of this patent is extended or adjusted under 35 U.S.C. 154(b) by 315 days.

(21) Appl. No.: 13/900,230

(22) Filed: May 22, 2013

(65) Prior Publication Data

US 2013/0312838 A1 Nov. 28, 2013

Related U.S. Application Data

(60) Provisional application No. 61/650,361, filed on May 22, 2012.

(51) Int. Cl.
*F02M 37/00* (2006.01)
*F02M 25/08* (2006.01)

(52) U.S. Cl.
CPC ..... *F02M 37/0076* (2013.01); *F02M 25/0818* (2013.01); *Y10T 137/0396* (2015.04); *Y10T 137/7069* (2015.04)

(58) Field of Classification Search
USPC ..... 137/14, 383; 220/201–380; 123/519
See application file for complete search history.

(56) References Cited

U.S. PATENT DOCUMENTS 4,527,406 A * 7/1985 Baker ..... B60K 15/0409 220/210
4,794,768 A * 1/1989 Moser ..... B60K 15/0409 70/165
6,374,811 B1 * 4/2002 Mancini ..... F02M 25/08 123/516
7,225,795 B2 * 6/2007 Mills ..... B60K 15/03504 123/516
7,311,088 B1 * 12/2007 Callahan ..... B01D 53/0431 123/516
9,096,120 B2 * 8/2015 Jean ..... B60K 15/0406
2008/0264941 A1 * 10/2008 Hebert ..... F01P 11/0238 220/203.07
2011/0084076 A1 * 4/2011 Whelan ..... F02M 37/0076 220/367.1
2012/0074147 A1 * 3/2012 Nirenberg ..... B60K 15/03519 220/367.1
2013/0312838 A1 * 11/2013 McLain ..... F02M 37/0076 137/14

* cited by examiner

*Primary Examiner* — Stephen K Cronin
*Assistant Examiner* — Joshua A Campbell

(57) ABSTRACT

A component of a fuel system includes a fuel cap having a head portion connected to a neck portion. The head portion defines: a fluid pressure relief conduit and a relief valve passage that extends into and through the head portion that terminates at a valve head opening formed by an inner surface of the head portion. The inner surface of the head portion and the inner surface of the neck portion cooperate to form a fuel cap cavity. The fluid cap cavity is fluidly-connected to the fluid pressure relief conduit by way of the valve head opening formed by the inner surface of the head portion. A relief valve is movably arranged within the relief valve passage for permitting selective fluid communication of the fuel cap cavity with the fluid pressure relief conduit. A locking apparatus is arranged within the fuel cap cavity.

8 Claims, 13 Drawing Sheets

16
3
3

FD
36
108
106
106a
116
106b
112
CANISTER
102
22b
14
24
26
$F_L$
22

COMPONENT OF A FUEL SYSTEM, FUEL SYSTEM AND METHOD FOR OPERATING THE SAME

CROSS-REFERENCE To RELATED APPLICATIONS

This U.S. Patent Application claims priority to U.S. Provisional Application: 61/650,361 filed on May 22, 2012, the disclosure of which is considered part of the disclosure of this application and is hereby incorporated by reference in its entirety.

FIELD OF THE INVENTION

The disclosure relates to a component of a fuel system, a fuel system and a method for operating the same.

DESCRIPTION OF THE RELATED ART

A contributing factor to poor air quality has been typically associated with the use of hydrocarbons, which are the basis for petroleum-based fuels that are burned by many automotive vehicles throughout the world. In the United States, air quality is regulated at the federal level by the Environmental Protection Agency (EPA) by way of the Clean Air Act of 1963. Additionally, at the state level, air quality is regulated by the California Air Resources Board (CARB), which operates as a department within the California Environmental Protection Agency (Cal/EPA), which is a cabinet-level agency within the government of the state of California.

Each of the EPA and CARB administer regulations requiring vehicle manufacturers to limit the amount of hydrocarbons that escape to atmosphere. Accordingly, there is a need in the art to improve vehicle design that will comply with regulations administered by one or both of the EPA and CARB.

SUMMARY

One aspect of the invention provides a component of a fuel system includes a fuel cap. The fuel cap includes a head portion connected to a neck portion. The head portion includes an inner surface and an outer surface. The neck portion includes an inner surface and an outer surface. The head portion defines: a fluid pressure relief conduit that extends into the head portion from a first opening formed in the outer surface of the head portion and a relief valve passage that extends into and through the head portion from a second opening formed in the outer surface of the head portion and terminates at a valve head opening formed by the inner surface of the head portion. The relief valve passage intersects with and is in fluid communication with the fluid pressure relief conduit. The inner surface of the head portion and the inner surface of the neck portion cooperate to form a fuel cap cavity. The fluid cap cavity is fluidly-connected to the fluid pressure relief conduit by way of the valve head opening formed by the inner surface of the head portion. A relief valve is movably arranged within the relief valve passage for permitting selective fluid communication of the fuel cap cavity with the fluid pressure relief conduit. A locking apparatus is arranged within the fuel cap cavity. The locking apparatus includes a locking pin that extends through a locking pin passage formed by the neck portion of the fuel cap. The locking pin extends through the locking pin passage from the inner surface of the neck portion and beyond the outer surface of the neck portion.

In some implementations, a user-actuated button is arranged within the first opening formed in the outer surface of the head portion. A proximal end of the relieve valve is connected to a lower end surface of the user-actuated button. A heavy relief spring is arranged within the relief valve passage. A first end of the heavy relief spring is disposed adjacent the lower end surface of the user-actuated button. A second end of the heavy relief spring is disposed adjacent a ledge surface formed by the relief valve passage.

In some examples, a distal end of the relief valve is arranged within the valve head opening. A portion of a neck surface of the relief valve extends slightly beyond the inner surface of the head portion. A heavy relief spring biases the neck surface of the relief valve against the inner surface of the head portion for fluidly-sealing the valve head opening.

In some instances, a support member is connected to the inner surface of the neck portion and arranged within the fuel cap cavity. The support member includes an upper surface and a lower surface. A flange is connected to the upper surface of the support member and the inner surface of the head portion. The flange is connected to the locking apparatus.

In some implementations, the flange includes a plurality of segments. A first rigid segment of the plurality of segments is connected to the upper surface of the support member. A last rigid segment of the plurality of segments is connected to the inner surface of the head portion. The plurality of segments includes a non-rigid, flexible diaphragm segment arranged between the first rigid segment and the last rigid segment. The non-rigid, flexible diaphragm segment is connected to the locking apparatus.

In some examples, the locking apparatus includes a calibrated spring having a first end connected to the last rigid segment of the plurality of segments of the flange and a second end connected to the non-rigid, flexible diaphragm segment of the plurality of segments of the flange. The calibrated spring imparts a biasing force toward the non-rigid, flexible diaphragm segment. A pivot is connected to the inner surface of the neck portion. A rocker arm is pivotably-connected to the pivot. A linkage connects a first end of the rocker arm to the non-rigid, flexible diaphragm segment of the plurality of segments of the flange. The locking pin is connected to a second end of the rocker arm.

In some instances, the biasing force flexes the non-rigid, flexible diaphragm segment away from the inner surface of the head portion for causing the linkage to pull and thereby pivot the rocker arm about the pivot for pulling the locking pin through the locking pin passage and into the fuel cap cavity such that the locking pin is arranged in an unlocked orientation relative to the neck portion. Application of a force that is opposite to and greater than the biasing force flexes the non-rigid, flexible diaphragm segment toward the inner surface of the head portion for causing the linkage to push and thereby pivot the rocker arm about the pivot for pushing the locking pin through the locking pin passage and out of the fuel cap cavity such that the locking pin is arranged in a locked orientation relative to the neck portion.

In some implementations, the outer surface of the neck portion defines an outer threaded surface portion that corresponds to an inner threaded surface portion of a fuel depositing conduit for threadingly-coupling the fuel cap to the fuel depositing conduit.

In some examples, a seal ring is arranged about the outer surface of the neck portion for sealing a fluid path between the outer threaded surface portion of the fuel cap and the inner threaded surface portion of the fuel line conduit when the fuel cap is threadingly-coupled to the fuel depositing conduit.

Another aspect of the disclosure provides a fuel system including a fuel tank, an evaporative emissions system, a fuel cap, a relief valve and a locking apparatus. The fuel tank includes a fuel depositing conduit. The fuel depositing conduit includes an inner threaded surface portion. The evaporative emissions system fluidly-connects the fuel depositing conduit by a fluid conduit. A fuel cap includes a head portion connected to a neck portion that forms a fuel cap cavity that is in fluid communication with the fuel depositing conduit. The head portion includes an inner surface and an outer surface. The neck portion includes an inner surface and an outer surface. The outer surface of the neck portion defines an outer threaded surface portion that corresponds to the inner threaded surface portion of the fuel depositing conduit for threadingly-coupling the fuel cap to the fuel depositing conduit. The relief valve is movably arranged within a relief valve passage of the head portion of the fuel cap for permitting selective fluid communication of the fuel cap cavity with a fluid pressure relief conduit of the head portion of the fuel cap. The locking apparatus is arranged within the fuel cap cavity. The locking apparatus includes a locking pin that is supported within a locking pin passage formed by the neck portion of the fuel cap. The locking pin is also selectively-arranged within a locking-pin-receiving passage formed by the fuel depositing conduit that is axially-aligned with the locking pin passage for selectively securing the fuel cap to the fuel depositing conduit.

In some implementations, the evaporative emissions system includes a canister and a vent valve. The vent valve includes a fluid input and a fluid output. The fluid input is fluidly-connected to the fluid conduit. The fluid output is fluidly-connected to the canister.

In some examples, a control module is communicatively-coupled to the vent valve and an instrument panel fuel cap unlocking button.

In some instances, the fluid pressure relief conduit extends into the head portion from a first opening formed in the outer surface of the head portion. The relief valve passage extends into and through the head portion from a second opening formed in the outer surface of the head portion and terminates at a valve head opening formed by the inner surface of the head portion. The relief valve passage intersects with and is in fluid communication with the fluid pressure relief conduit. The inner surface of the head portion and the inner surface of the neck portion cooperate to form the fuel cap cavity. The fluid cap cavity is fluidly-connected to the fluid pressure relief conduit by way of the valve head opening formed by the inner surface of the head portion.

In yet another aspect of the disclosure, a method includes the steps of: providing a fuel system including a fuel tank, a fuel cap, a fuel depositing conduit and an evaporative emissions system that are fluidly-connected; removably-connecting the fuel cap to the fuel depositing conduit for isolating internal pressure of the fuel tank from atmospheric pressure; upon an increase of the internal pressure of the fuel tank, utilizing the internal pressure of the fuel tank to mechanically manipulate an orientation of a locking apparatus of the fuel cap for locking the fuel cap to the fuel depositing conduit.

In some implementations, the method includes actuating a relief valve movably arranged within the fuel cap for permitting the internal pressure of the fuel tank to be exposed to atmospheric pressure to mechanically manipulate the orientation of the locking apparatus of the fuel cap for unlocking the fuel cap from the fuel depositing conduit.

In some example, the method includes the step of actuating an instrument panel button for communicating a control signal to the evaporative emissions system.

In some instances, the actuating step results in a change of orientation of a vent valve of the evaporative emissions system from a closed orientation to an open orientation for relieving the internal pressure of the fuel tank to mechanically manipulate the orientation of the locking apparatus of the fuel cap for unlocking the fuel cap from the fuel depositing conduit.

In some implementations, the method includes the step of responsive to a communication malfunction that prevents communication of the control signal to the evaporative emissions system, actuating a relief valve movably arranged within the fuel cap for permitting the internal pressure of the fuel tank to be exposed to atmospheric pressure to mechanically manipulate the orientation of the locking apparatus of the fuel cap for unlocking the fuel cap from the fuel depositing conduit.

BRIEF DESCRIPTION OF THE DRAWINGS

The disclosure will now be described, by way of example, with reference to the accompanying drawings, in which.

DETAILED DESCRIPTION OF THE INVENTION

The Figures illustrate exemplary embodiments of a component of a fuel system, a fuel system and a method for operating the same. Based on the foregoing, it is to be generally understood that the nomenclature used herein is simply for convenience and the terms used to describe the invention should be given the broadest meaning by one of ordinary skill in the art.

Figure 1:
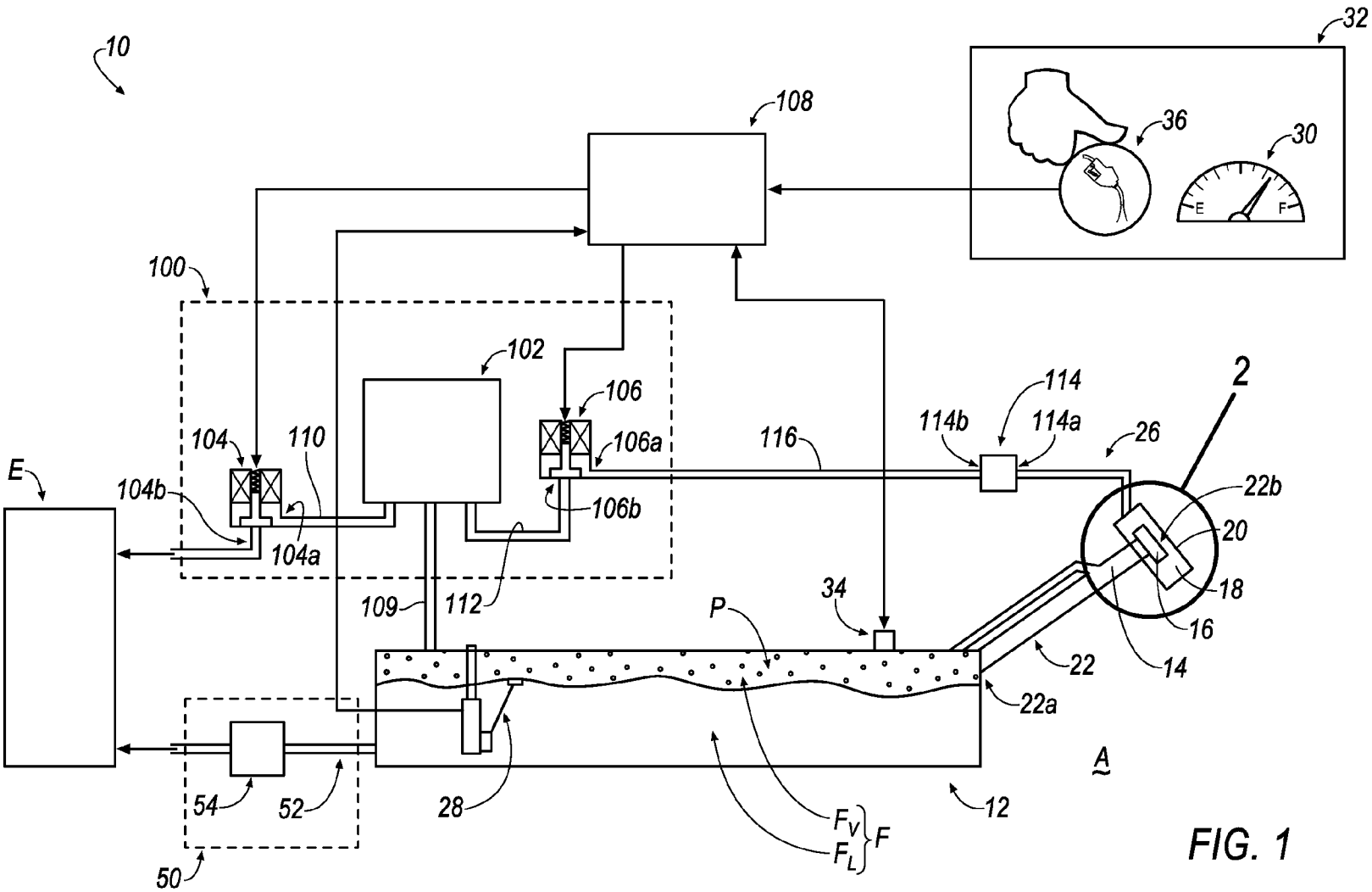
FIG. 1 is a view of an exemplary fuel system.

Referring to FIG. 1, a fuel system 10 including a fuel tank 12 connected to an engine, E, is shown. The fuel system 10 may include a liquid fuel delivering sub-system 50 and a vapor fuel delivering sub-system, which may be referred to as an evaporative emissions (EVAP) system 100. Once fuel, F, is received by the engine, E (by way of the liquid fuel delivering sub-system 50 and/or the EVAP system 100) of a vehicle, the engine, E, combusts a mixture of air and the fuel, F, within one or more cylinders (not shown) of the engine, E, in order to generate drive torque; the fuel, F, of the air-fuel mixture may be, for example, a combination of the liquid fuel, $F_L$, and the vapor fuel, $F_V$. In some vehicles, the drive torque generated by the engine, E, may be used to propel the vehicle; in such vehicles, the drive torque output by the engine, E, may be transferred to a transmission (not shown), and, the transmission may transfer the drive torque to one or more wheels (not shown) of the vehicle.

In other vehicles, such as, for example, parallel-hybrid vehicles, torque output by the engine, E, may not be transferred to the transmission. Instead, torque output by the engine, E, may be converted into electrical energy by, for example, a motor-generator (not shown) or a belt alternator starter (BAS) (not shown). The electrical energy may be provided to, for example: (1) the motor-generator, (2) another motor-generator (not shown), (3) an electric motor (not shown), and/or (4) an energy storage device (not shown). The electrical energy may be used to generate torque to propel the vehicle. Some hybrid vehicles may also receive electrical energy from an alternating current (AC) power source (not shown), such as, for example, a standard wall outlet; such hybrid vehicles may be referred to as plug-in hybrid vehicles. Accordingly, in some implementations, the fuel system 10 may supply fuel, F, to an engine, E, of a plug-in hybrid vehicle; in other implementations, the fuel system 10 may supply the liquid fuel, $F_L$, and the vapor fuel, $F_V$, to the engine, E. While some implementations of the fuel system 10 may be described as in the context of a plug-in hybrid vehicle, the present disclosure is also applicable to other types of vehicles having an internal combustion engine, E, and is not meant to be limited to a particular type of vehicle.

The fuel system 10 may be said to be a "sealed" system (i.e., the fuel system 10 is sealed from atmosphere/atmospheric pressure, A). Because the fuel tank 12 is a component of the "sealed" fuel tank system 10, internal pressure, P, of the fuel 12 tank may be said to be isolated from atmosphere/atmospheric pressure, A (i.e., the internal pressure, P, of the fuel tank 12 may be defined by a unique pressure value that is different from atmospheric pressure, A, until, for example, atmospheric pressure, A, is selectively permitted by a user (see, e.g., FIGS. 5A, 6B-6C) to be exposed to the fuel system 10). Accordingly, when the fuel system 10 is arranged in a "sealed" orientation, one or more stimuli (e.g., one or more changes of operating temperature of the fuel system 10, ambient temperature relative to the fuel system 10, vibrations of the fuel system 10, radiation imparted to the fuel system 10 and the like) may cause a change in the internal pressure, P (see, e.g., FIGS. 4A-4B), of the fuel tank 12.

Figure 2A:
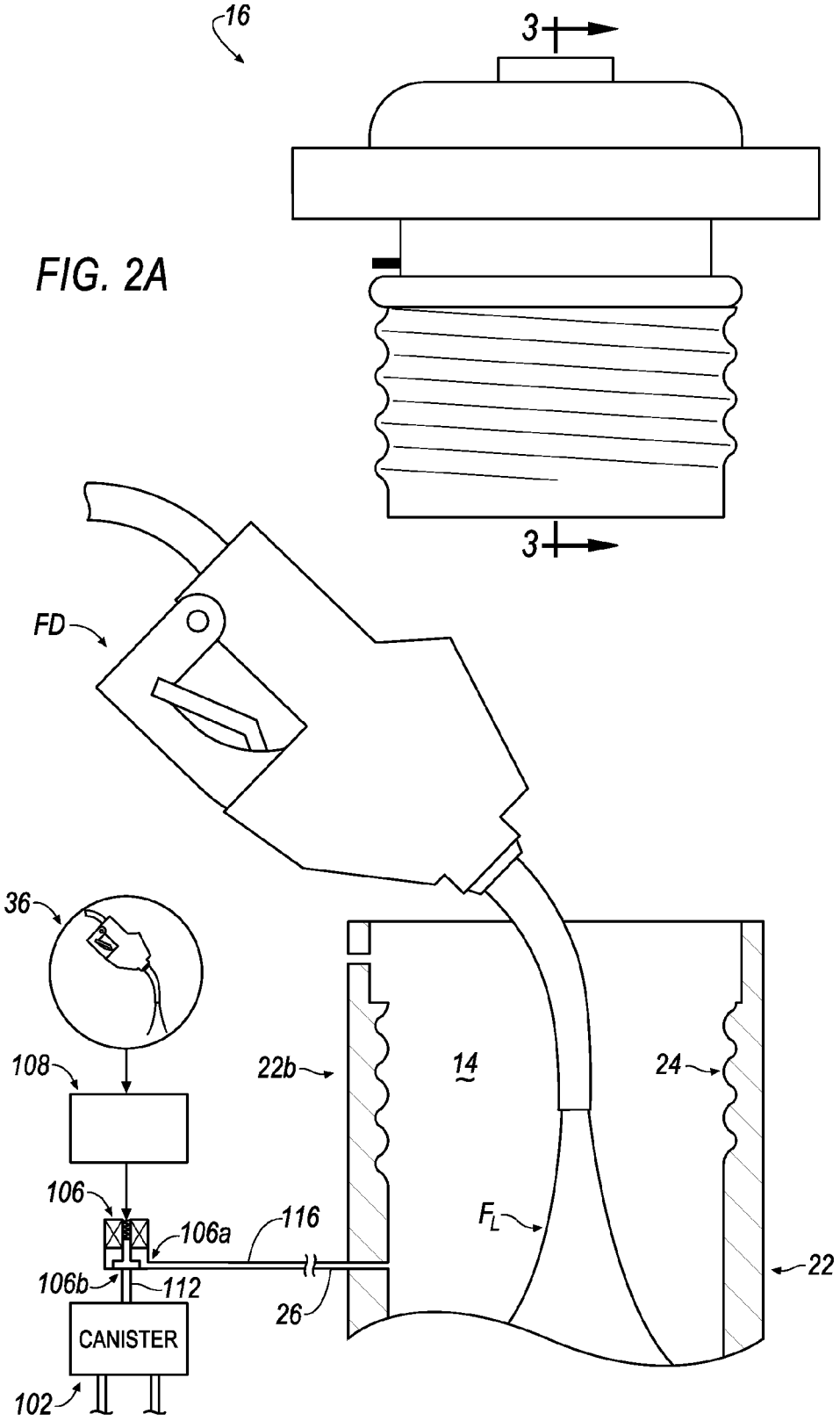
FIG. 2A is a view of an exemplary portion of the fuel system of FIG. 1.

As seen in FIG. 1, the fuel tank 12 stores fuel, F, which may be defined to include liquid fuel, $F_L$, and vapor fuel, $F_V$. Referring to FIG. 2A, the liquid fuel, $F_L$, may be deposited into the fuel tank 12 from a fuel dispenser, FD. The fuel dispenser, FD, may be arranged near an opening 14 formed by the fuel tank 12. Environmental/ambient conditions relative to the fuel tank 12, such as, for example: one or more of a combination temperature, vibrations, and radiation may cause the liquid fuel, $F_L$, disposed within the fuel tank 12 to vaporize and thereby form the vapor fuel, $F_V$.

Figure 2B:
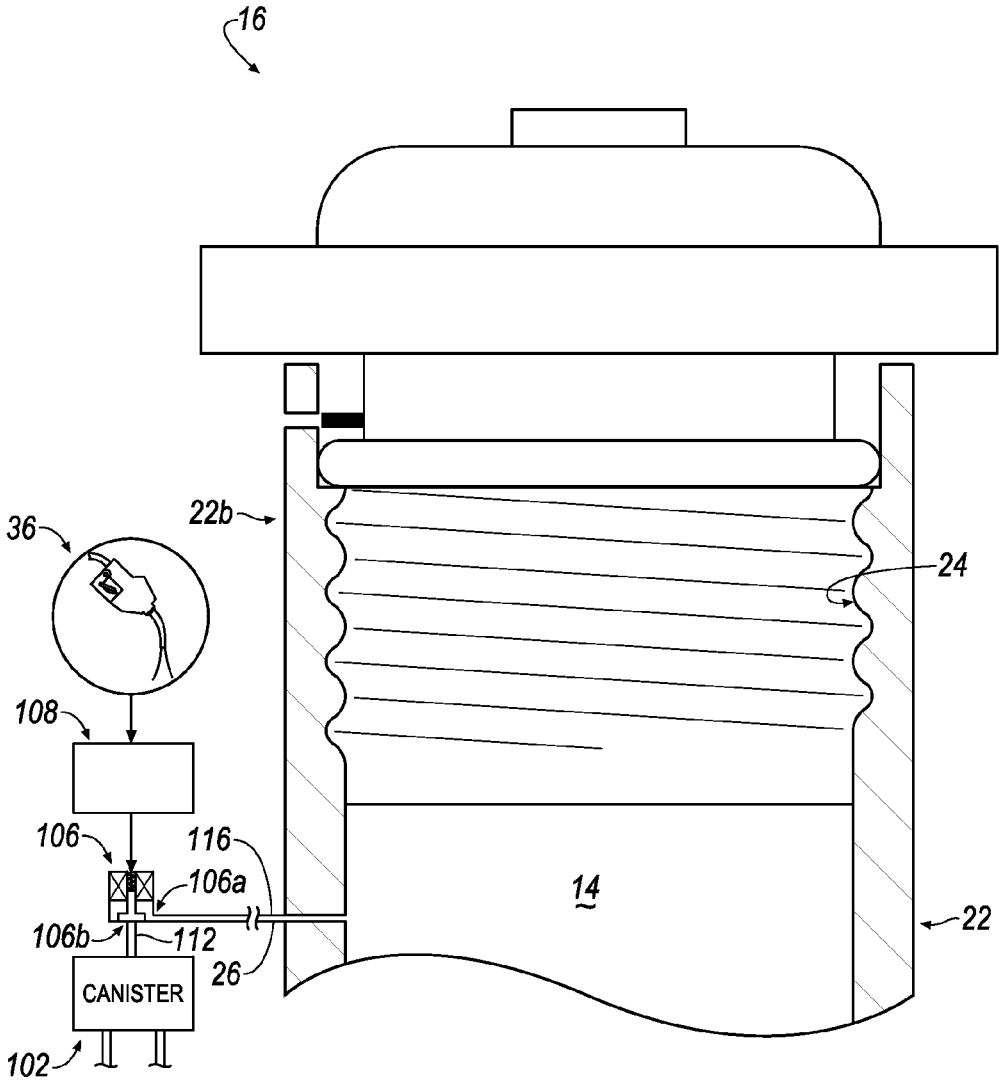
FIG. 2B is another view of the portion of the fuel system of FIG. 2A.

As seen in FIGS. 1 and 2A-2B, a fuel cap 16 may be removably-attached to the fuel tank 12 for providing selective access to the opening 14. As seen in FIG. 1, the fuel cap 16 may be arranged within a fueling compartment 18 formed by the fuel tank 12. A fuel door 20 may form a portion of an exterior body (not shown) of a vehicle and may be selectively arranged in an opened orientation or a closed orientation in order to provide selective access to the fueling compartment 18.

Referring to FIGS. 1 and 2A-2B, the opening 14 may be defined by a fuel depositing conduit 22. The fuel depositing conduit 22 may include a proximal end 22*a* (see FIG. 1) fluidly-connected to the fuel tank 12. The fuel depositing conduit 22 may include a distal end 22*b* (see FIGS. 1 and 2A-2B) including an inner threaded surface portion 24 for permitting the fuel cap 16 to be mechanically-coupled/threadingly-coupled to the fuel depositing conduit 22.

As seen in FIG. 1, the fueling compartment 18 may be generally arranged about, near or proximate the distal end 22*b* of the fuel depositing conduit 22. As seen in FIGS. 1 and 2A-2B, one or more of the fueling compartment 18 and the distal end 22*b* of the fuel depositing conduit 22 may form a fuel tank pressure-alleviating fluid conduit 26 that is fluidly connected to and extends away from one or more of the fueling compartment 18 and the distal end 22*b* of the fuel depositing conduit 22.

Referring to FIG. 1, a fuel level sensor 28 may be arranged within the fuel tank 12 for measuring an amount of the liquid fuel, $F_L$, disposed within the fuel tank 12. The fuel level sensor 28 generates a fuel level signal that may be displayed upon a fuel level display 30 of an instrument panel 32 of the vehicle. The amount of liquid fuel, $F_L$, disposed within the fuel tank 12 may be expressed on the fuel level display 30 in terms of, for example: a volume of the fuel tank 12, a percentage of a maximum volume of the fuel tank 12, or another suitable measure of the amount of liquid fuel, $F_L$, within the fuel tank 12.

Further, in some implementations, the fuel system 10 may also include a pressure sensor 34 that may be fluidly-connected to the fuel tank 12. The pressure sensor 34 may detect the internal pressure, P, of the fuel tank 12. The pressure sensor 34 may be communicatively-coupled to a control module (see, e.g., 108) in order to communicate the internal pressure, P, of the fuel tank 12 detected by the pressure sensor 34 to the control module.

The fuel system 10 also includes structure for connecting the fuel tank 12 to an engine, E, for the purpose of delivering the fuel, F, from the fuel tank 12 to the engine, E. As seen in FIG. 1, the structure connecting the fuel tank 12 to the engine, E, may include the liquid fuel delivering sub-system 50. A portion of the structure forming the liquid fuel delivering sub-system 50 that delivers the liquid fuel, $F_L$, to the engine, E, may include, for example, a liquid fuel line conduit 52 including a fuel injector 54.

Further, as seen in FIG. 1, the structure connecting the fuel tank 12 to the engine, E, may also include the EVAP system 100. In an implementation, the EVAP system 100 may include: a canister 102, a purge valve 104 and a vent valve 106. Functionally, the control module 108 may control the opened/closed orientation of the purge valve 104 and the vent valve 106 such that the EVAP system 100 may: (1) return vapor fuel, $F_V$, to the fuel tank 12 by way of a fluid conduit 109, (2) trap and store the vapor fuel, $F_V$, within the canister 102 (e.g., the canister 102 may include one or more substances, such as, for example, charcoal that stores the vapor fuel, $F_V$), and (3) deliver the vapor fuel, $F_V$, from the canister 102 to the engine, E. In an implementation, an input 104*a* of the purge valve 104 is fluidly-connected to the canister 102 by a fluid conduit 110; and output 104*b* of the purge valve 104 is fluidly-connected to the engine, E. An output 106*b* of the vent valve 106 is fluidly-connected to the canister 102 by a fluid conduit 112.

With continued reference to FIG. 1, the fuel system 10 includes a filter 114 having a "dirty air side" 114*a* and a "clean air side" 114*b*. A filtered fluid conduit 116 connects the clean air side 114*b* of the filter 114 to an input 106*a* of the vent valve 106. In an implementation, the fuel tank pressure alleviating conduit 26 fluidly-connects one or more of the fueling compartment 18 and the distal end 22*b* of the fuel depositing conduit 22 to the dirty air side 114*a* of the filter 114.

In another implementation, the filter 114 may not be included in the design of the fuel system 10 and the fuel tank pressure alleviating conduit 26 fluidly-connects one or more of the fueling compartment 18 and the distal end 22*b* of the fuel depositing conduit 22 to the input 106*a* of the vent valve 106. Further, in some implementations, the filtered fluid conduit 116 may include an EVAP leak check system (not shown) communicatively-coupled to one or more of the control module 108 and the pressure sensor 36 for determining if the fuel system 10 includes an undesirable fuel leak.

Figure 3:
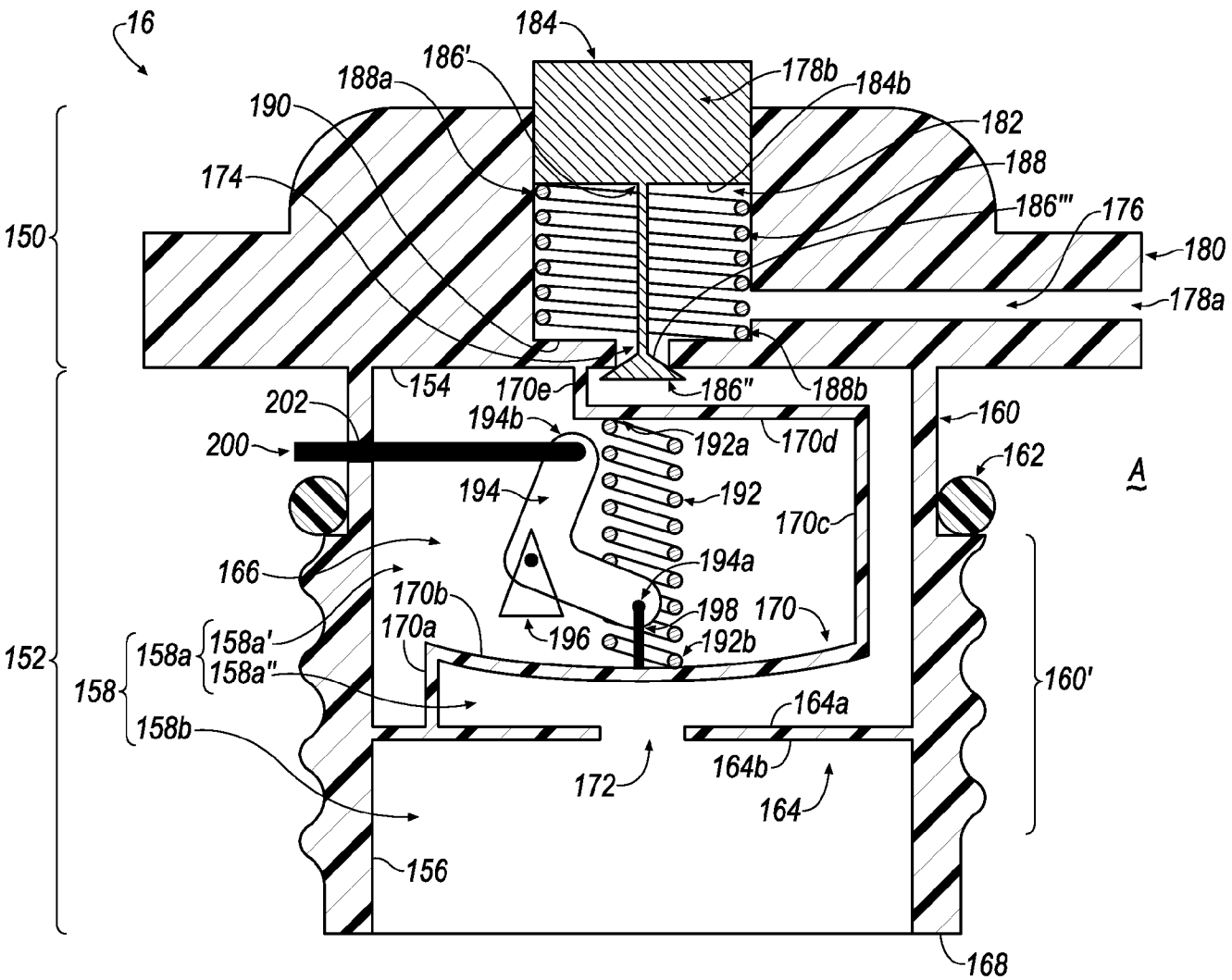
FIG. 3 is a cross-sectional view of an exemplary fuel cap according to line 3-3 of FIG. 2A.

Referring now to FIG. 3, an embodiment of the fuel cap 16 is shown. The fuel cap 16 includes a head portion 150 connected to a neck portion 152. An inner surface 154 of the head portion 150 and an inner surface 156 the neck portion 152 contribute to the formation of a fuel cap cavity 158.

The neck portion 152 includes an outer surface portion 160 including a threaded surface portion 160' that corresponds to the inner threaded surface portion 24 of the fuel depositing conduit 22 for mechanically-coupling/threadingly-coupling the fuel cap 16 to the fuel depositing conduit 22. A seal ring 162 may be arranged about the neck portion 152 for sealing a fluid path between the threaded surface portions 24, 160' of the fuel line conduit 22 and the fuel cap 16 when the fuel cap 16 is mechanically-coupled/threadingly-coupled to the fuel depositing conduit 22.

The fuel cap 16 further includes a support member 164 and a locking apparatus 166 that are arranged within the cavity 158. The support member 164 extends across the cavity 158 substantially perpendicularly from the inner surface 156 of the neck portion 152 of the fuel cap 16 thereby separating the cavity 158 to include a first cavity segment 158*a* and a second cavity segment 158*b*. The first cavity segment 158*a* extends between the inner surface 154 of the head portion 150 and an upper surface 164*a* of the support member 164. The second cavity segment 158*b* extends between a lower surface 164*b* of the support member 164 and a distal end surface 168 of the neck portion 152. The locking apparatus 166 is arranged within the first cavity segment 158*a* between the inner surface 154 of the head portion 150 and the upper surface 164*a* of the support member 164.

The locking member 166 is supported by a flange 170 within the first cavity segment 158*a*. In an embodiment, the flange 170 may be defined by a plurality of segment portions including a first segment portion 170*a* that is connected to a second segment portion 170*b* that is connected to a third segment portion 170*c* that is connected to a fourth segment portion 170*d* that is connected to a fifth segment portion 170*e*. The first segment portion 170*a* is connected to the upper surface 164*a* of the support member 164. The fifth segment portion 170*e* is connected to the inner surface 154 of the head portion 150 of the fuel cap 16.

The plurality of segment portions 170*a*-170*e* forms the first cavity segment 158*a* into a first cavity segment portion 158*a*' and a second cavity segment portion 158*a*". The first cavity segment portion 158*a*' stows the locking apparatus 166 within the fuel cap 16. The second cavity segment portion 158*a*" generally defines a fuel cap neck portion fluid conduit.

Access to the fuel cap neck portion fluid conduit 158*a*" is permitted by an opening 172 formed in the support member 164 and an opening 174 formed in the inner surface 154 of the head portion 150. The opening 172 fluidly-connects the fuel cap neck portion fluid conduit 158*a*" with the second cavity segment 158*b*. The opening 174 fluidly-connects the fuel cap neck portion fluid conduit 158*a*" with a head portion fluid conduit 176 extending through the head portion 150 of the fuel cap 16. The head portion fluid conduit 176 extends between the opening 174 formed in the inner surface 154 of the head portion 150 and a first exterior opening 178*a* formed in an outer surface 180 of the head portion 150 that is in fluid communication with atmospheric pressure, A.

A second exterior opening 178*b* is formed in the head portion 150 of the fuel cap 16. The second exterior opening 178*b* provides access to a passage 182 extending into the head portion 150 of the fuel cap 16. A user-actuated button 184 may be arranged within the second exterior opening 178*b* and extend into the passage 182. A relief valve 186 is connected to the user-actuated button 184 and extends into the passage 182. A proximal end 186' of the relief valve 186 is connected to and extends away from a lower end surface 184*b* of the user-actuated button 184 and a distal end 186" of the relief valve 186 is arranged within the fuel cap neck portion fluid conduit 158*a*".

A heavy relief spring 188 is arranged within the passage 182. A first, upper end 188*a* of the heavy relief spring 188 is disposed adjacent a lower end surface 184*b* of the user-actuated button 184. A second, lower end 188*b* of the heavy relief spring 188 is disposed adjacent a ledge surface 190 defined by one or more of the head portion fluid conduit 176 and the passage 182. In an expanded state, the heavy relief spring 188 exerts a force against the lower end surface 184*b* of the user-actuated button 184 thereby biasing/pulling a neck surface 186'" of the relief valve 186 against the inner surface 154 of the head portion 150 to thereby fluidly-sealing/closing-out the opening 174 that provides access to the head portion fluid conduit 176 that is in fluid communication with atmospheric pressure, A.

The flange 170 may be formed from a rigid material; however, in an embodiment, at least one segment (see, e.g., segment 170*b*) of the plurality of segments 170*a*-170*e* defining the flange 170 may include a non-rigid, flexible material. In an implementation, the second segment portion 170*b* of the flange 170 may include a flexible material and may be referred to as a flexible diaphragm.

The locking apparatus 166 may include a calibrated spring 192, a rocker arm 194 arranged upon a pivot 196, a linkage 198 connected to a first end 194*a* of the rocker arm 194 and a locking pin 200 connected to a second end 194*b* of the rocker arm 194. The pivot 196 may be connected to the inner surface 156 of the neck portion 152. The locking pin 200 may be arranged within the first cavity segment portion 158*a*', extend through a locking pin passage 202 formed by the neck portion 152 of the fuel cap 16 and beyond the outer surface portion 160 of the neck portion 152 of the fuel cap 16.

A first, upper end 192*a* and a second, lower end 192*b* of the calibrated spring 192 may be connected to the flange 170. In an embodiment, the first, upper end 192*a* of the calibrated spring 192 may be connected to the fourth segment portion 170*d* defined by a substantially rigid material, and, the second, lower end 192*b* of the calibrated spring 192 may be connected to the flexible diaphragm 170*b* thereby exerting a biasing force, $F_{192}$, toward the diaphragm 170*b*. The force imparted to the flexible diaphragm by the calibrated spring 192 flexes the flexible diaphragm 170*b* away from the head portion 150 of the fuel cap 16.

Figure 4A:
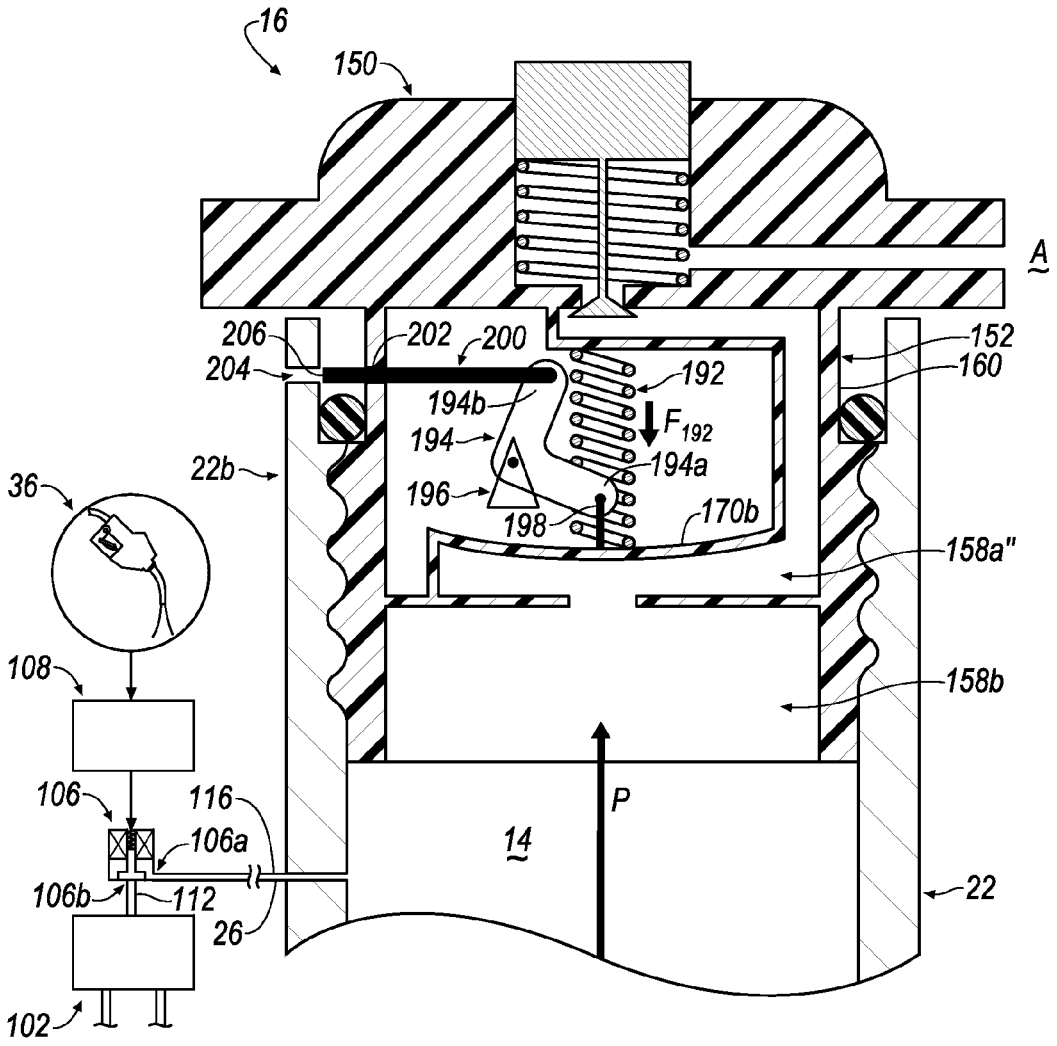
FIG. 4A is a view of the portion of the fuel system of FIG. 2B including the exemplary fuel cap of FIG. 3 arranged in an unlocked orientation.
Figure 4B:
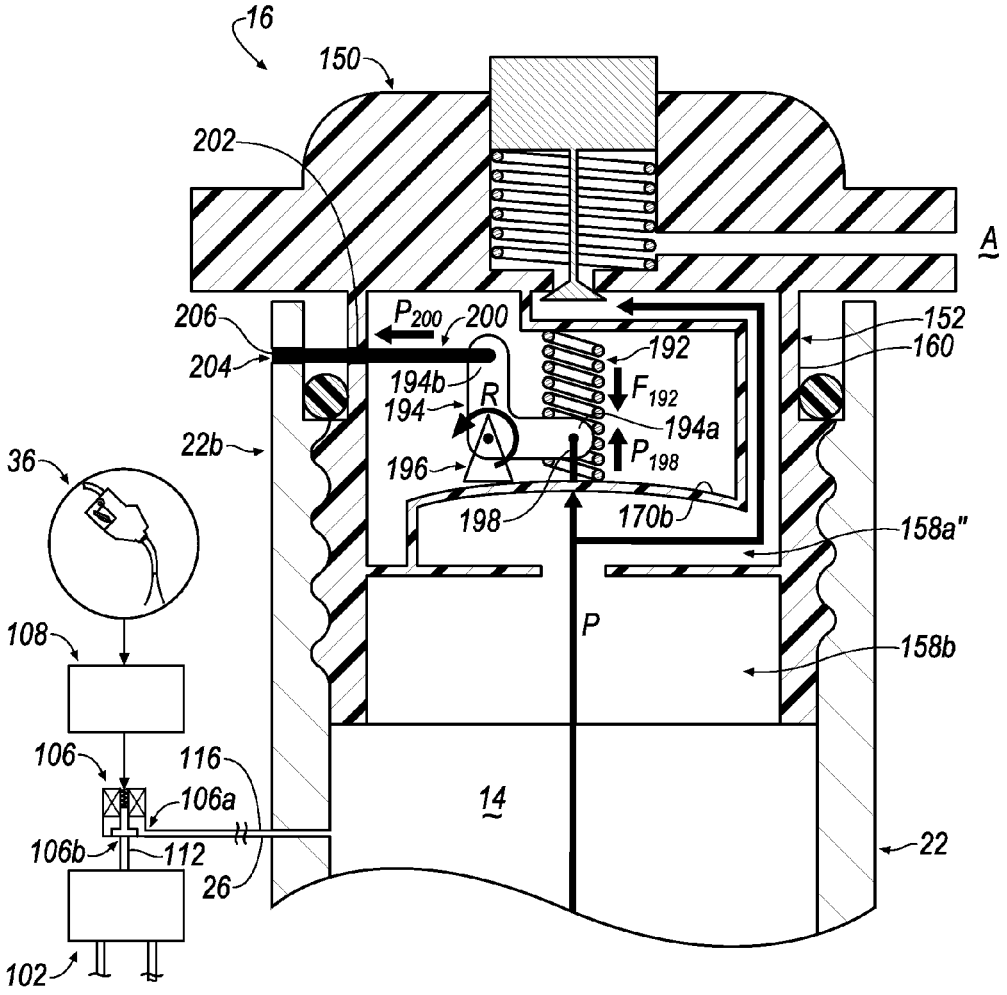
FIG. 4B is a view of the portion of the fuel system of FIG. 2B including the exemplary fuel cap of FIG. 3 arranged in a locked orientation.

Referring now to FIGS. 4A-4B a method for arranging the fuel cap 16 in a locked orientation with the fuel depositing conduit 22 is described according to an embodiment. As described above, the fuel system 10 is a "sealed" system, fluidly-isolating the internal pressure, P, of the fuel tank 12 from atmospheric pressure, A. The fuel tank 12 fluidly-communicates with the opening 14 defined by a fuel depositing conduit 22, the second cavity segment 158*b* of the fuel cap cavity 158 and the fuel cap neck portion fluid conduit 158*a*"; accordingly, the internal pressure, P, of the fuel tank 12 is exposed to: the opening 14 defined by a fuel depositing conduit 22, the second cavity segment 158*b* of the fuel cap cavity 158 and the fuel cap neck portion fluid conduit 158*a*".

As seen in FIG. 4A, in some implementations, the internal pressure, P, of the fuel tank 12 may be low (e.g., the internal pressure, P, of the fuel tank 12 may be equal to approximately about 30 kPa, and, as such, the internal pressure, P, of the fuel tank 12 does not overcome a biasing force, $F_{192}$, imparted by the calibrated spring 192 to the flexible diaphragm 170*b*. Referring to FIG. 4B, one or more stimuli (e.g., one or more changes of operating temperature of the fuel system 10, ambient temperature relative to the fuel system 10, vibrations of the fuel system 10, radiation imparted to the fuel system 10 and the like) may result in a change (i.e., an increase) of the internal pressure, P, of the fuel tank 12 thereby overcoming the biasing force, $F_{192}$, imparted by the calibrated spring 192 to the flexible diaphragm 170*b*.

Upon overcoming biasing force, $F_{192}$, imparted by the calibrated spring 192 to the flexible diaphragm 170*b*, the flexible diaphragm 170*b* flexes toward the head portion 150 of the fuel cap 16; as a result of the flexible diaphragm 170*b* flexing toward the head portion 150 of the fuel cap 16, the flexible diaphragm 170*b* pushes, $P_{198}$, the linkage 198 connected to the first end 194*a* of the rocker arm 194, which causes the rocker arm 194 to rotate, R, about the pivot 196, which causes the second end 194*b* of the rocker arm 194 to push, $P_{200}$, the locking pin 200 through the locking pin passage 202 formed by the neck portion 152 of the fuel cap 16 and further beyond the outer surface portion 160 of the neck portion 152 of the fuel cap 16.

As seen in FIGS. 4A-4B, the distal end 22*b* of the fuel depositing conduit 22 may form a locking-pin-receiving passage 204 that is axially-aligned with the locking pin passage 202 formed by the neck portion 152 of the fuel cap 16. Upon the second end 194*b* of the rocker arm 194 pushing, $P_{200}$, the locking pin 200 through the locking pin passage 202 as described above, a distal end 206 of the locking pin 200 registers within the locking-pin-receiving passage 204 thereby mechanically-coupling/mechanically locking the fuel cap 16 to the distal end 22*b* of the fuel depositing conduit 22.

Figure 5A:
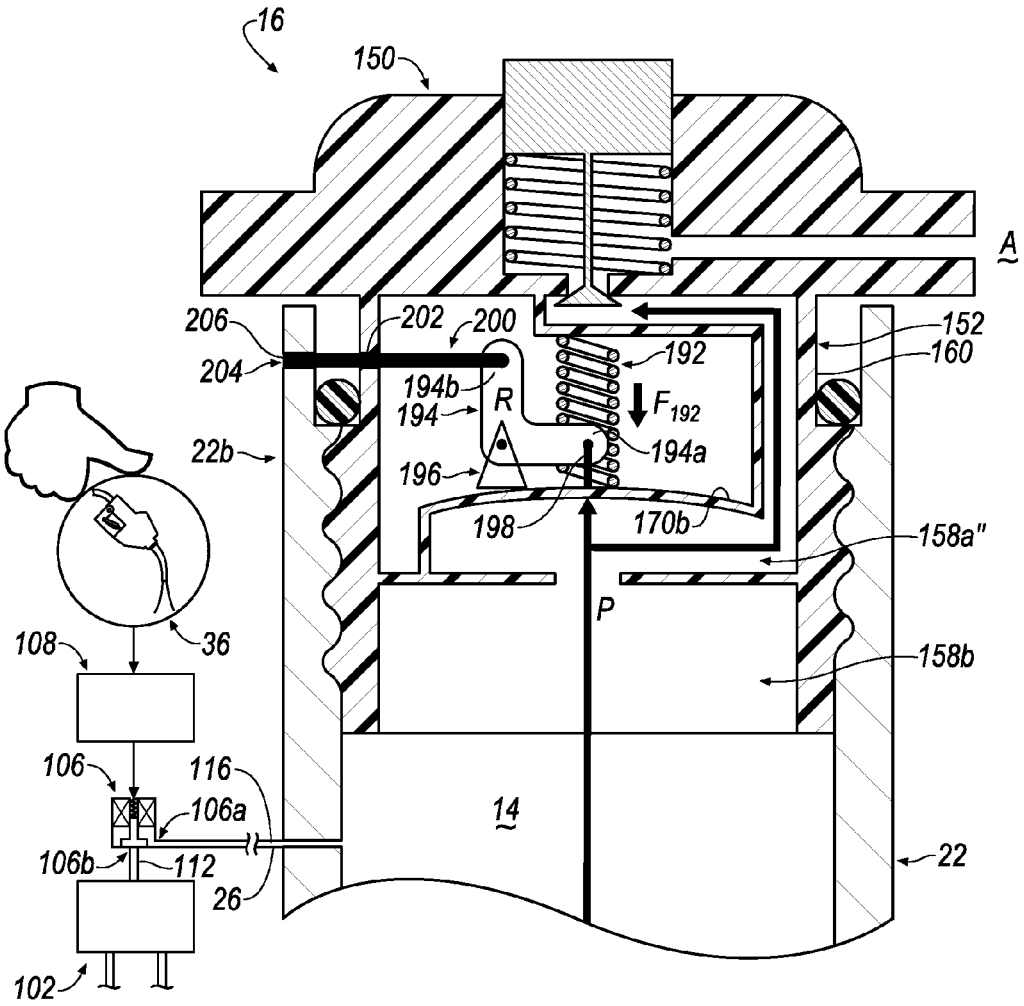
FIG. 5A is a view of the portion of the fuel system of FIG. 4B and a user attempting to unlock the portion of the fuel system.
Figure 5B:
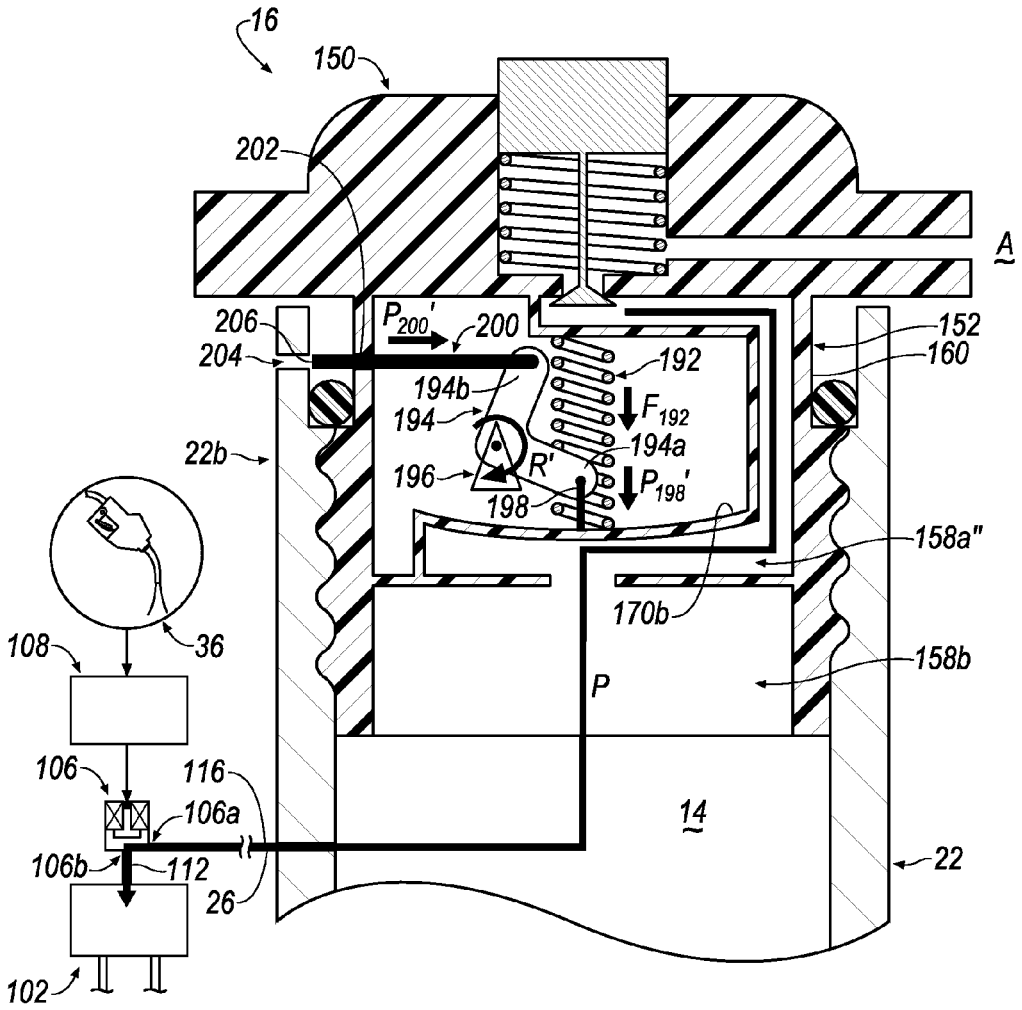
FIG. 5B is a view of the portion of the fuel system of FIG. 5A arranged in an unlocked orientation.
Figure 5C:
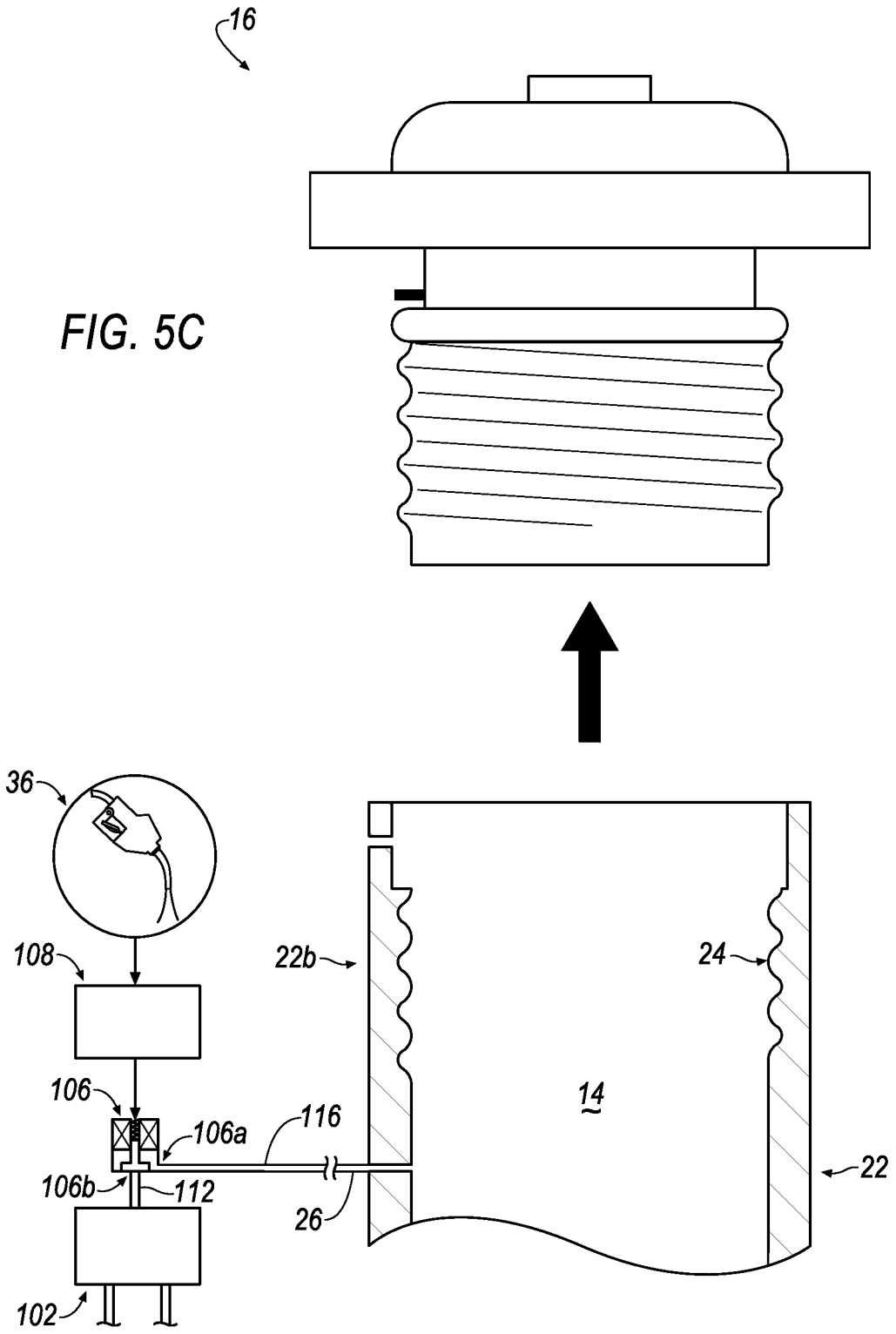
FIG. 5C is a view of the fuel cap of FIG. 5B detached from the portion of the fuel system.

Referring now to FIGS. 5A-5B, after the fuel cap 16 is arranged in the locked orientation with the fuel depositing conduit 22 as described above in FIGS. 4A-4B, a method for returning the fuel cap 16 to an unlocked orientation with respect to the fuel depositing conduit 22 is described according to an embodiment. By unlocking the fuel cap 16, the user may mechanically decouple the fuel cap 16 from the fuel depositing conduit 22 (see, e.g., FIG. 5C) in order to, for example, deposit fuel, F, into the fuel tank 12 as seen, for example, in FIG. 2A.

As seen in FIGS. 1 and 5A, the user may locate a fuel cap unlocking button 36 that is associated with the fuel system 10. In some implementations, the fuel cap unlocking button 36 may be located upon the instrument panel 32 of the vehicle. Upon the user actuating (e.g., pressing) the fuel cap unlocking button 36, a signal may be communicated to the control module 108 which may cause the vent valve 106 to be changed in orientation from a closed position (see FIG. 5A) to an open position (see FIG. 5B) in order to fluidly-couple the fuel tank pressure-alleviating fluid conduit 26 with the canister 102. Referring to FIG. 5B, by fluidly-coupling the fuel tank pressure-alleviating fluid conduit 26 with the canister 102, the internal pressure, P, of the fuel tank 12 may be reduced to thereby permit the biasing force, $F_{192}$, of the calibrated spring 192 to flex the flexible diaphragm 170*b* away from the head portion 150 of the fuel cap 16, which causes the flexible diaphragm 170*b* to pull, $P_{198}$' (opposite the arrow, $P_{198}$, of FIG. 4B), the linkage 198 connected to a first end 194*a* of the rocker arm 194, which causes the rocker arm 194 to rotate, R' (opposite the arrow, R, of FIG. 4B), about the pivot 196, which causes the second end 194*b* of the rocker arm 194 to retract, $P_{200}$' (opposite the arrow, $P_{200}$, of FIG. 4B), the locking pin 200 through the locking pin passage 202 formed by the neck portion 152 of the fuel cap 16 and away from the locking-pin-receiving passage 204 of the distal end 22*b* of the fuel depositing conduit 22 such that the distal end 206 of the locking pin 200 is no longer registered within the locking-pin-receiving passage 204 of the distal end 22*b* of the fuel depositing conduit 22 to thereby mechanically-decouple (see FIG. 5C)/mechanically unlock the fuel cap 16 from the distal end 22*b* of the fuel depositing conduit 22.

Figure 6A:
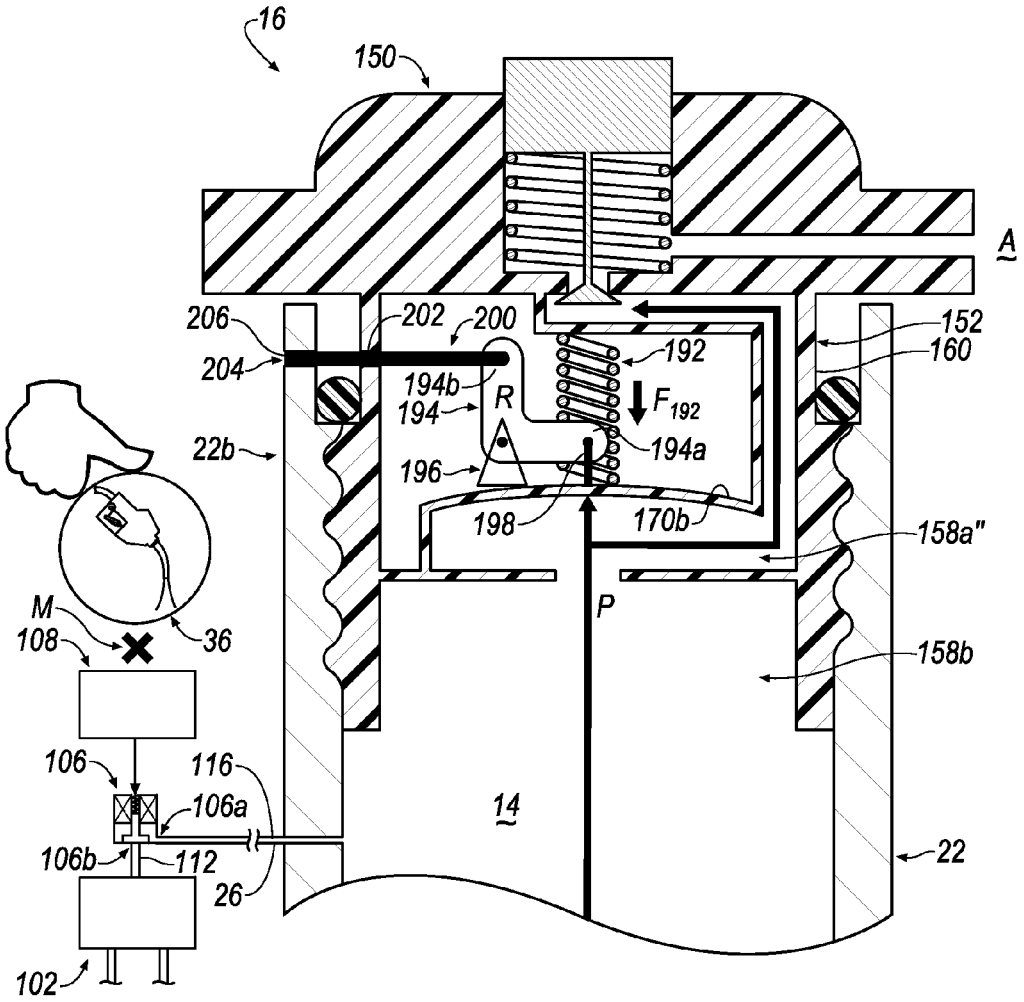
FIG. 6A is a view of the portion of the fuel system of FIG. 4B and a user attempting to unlock the portion of the fuel system.
Figure 6B:
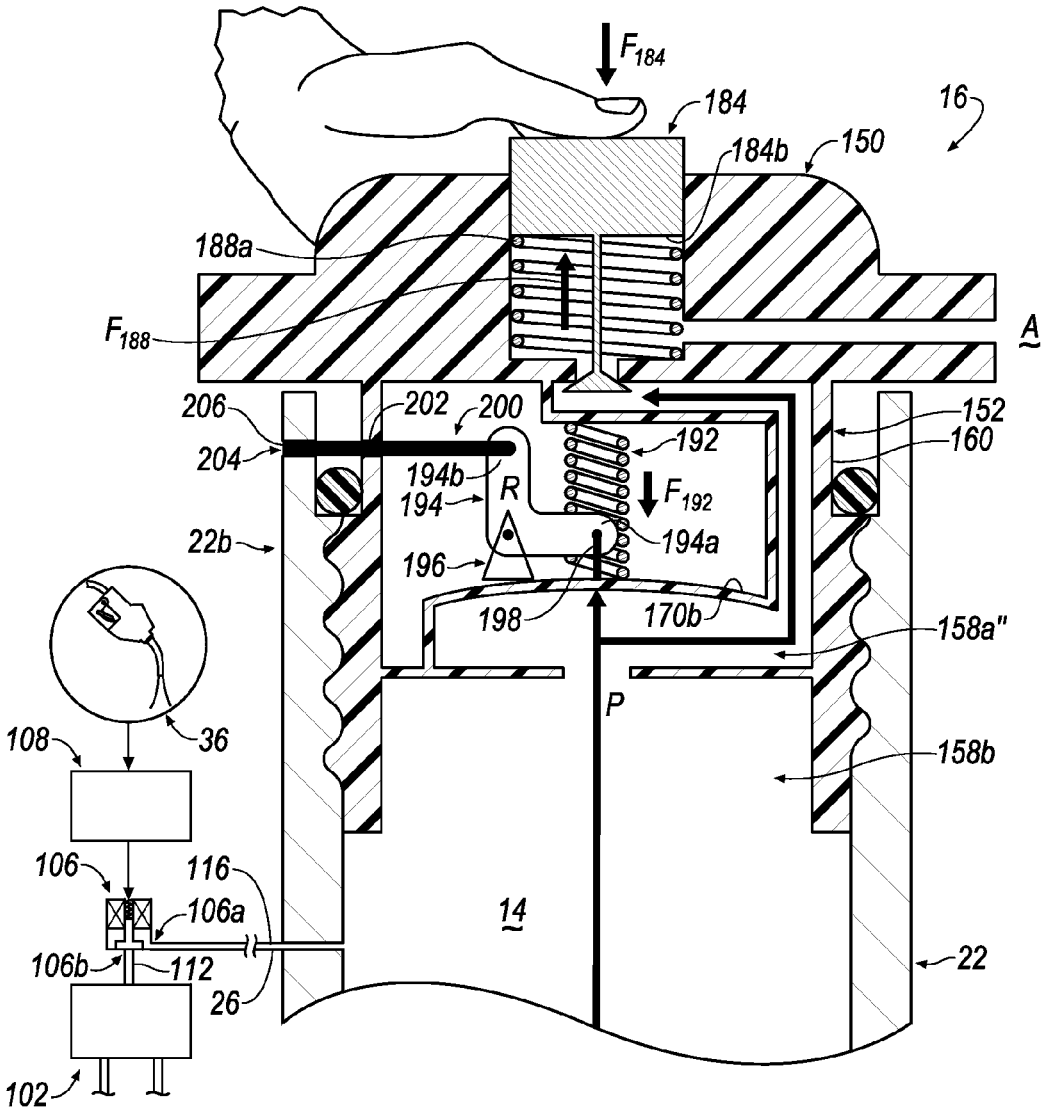
FIG. 6B is another view of the portion of the fuel system of FIG. 6A and the user attempting to unlock the portion of the fuel system after the first attempt to unlock the portion of the fuel system in FIG. 6A failed.
Figure 6C:
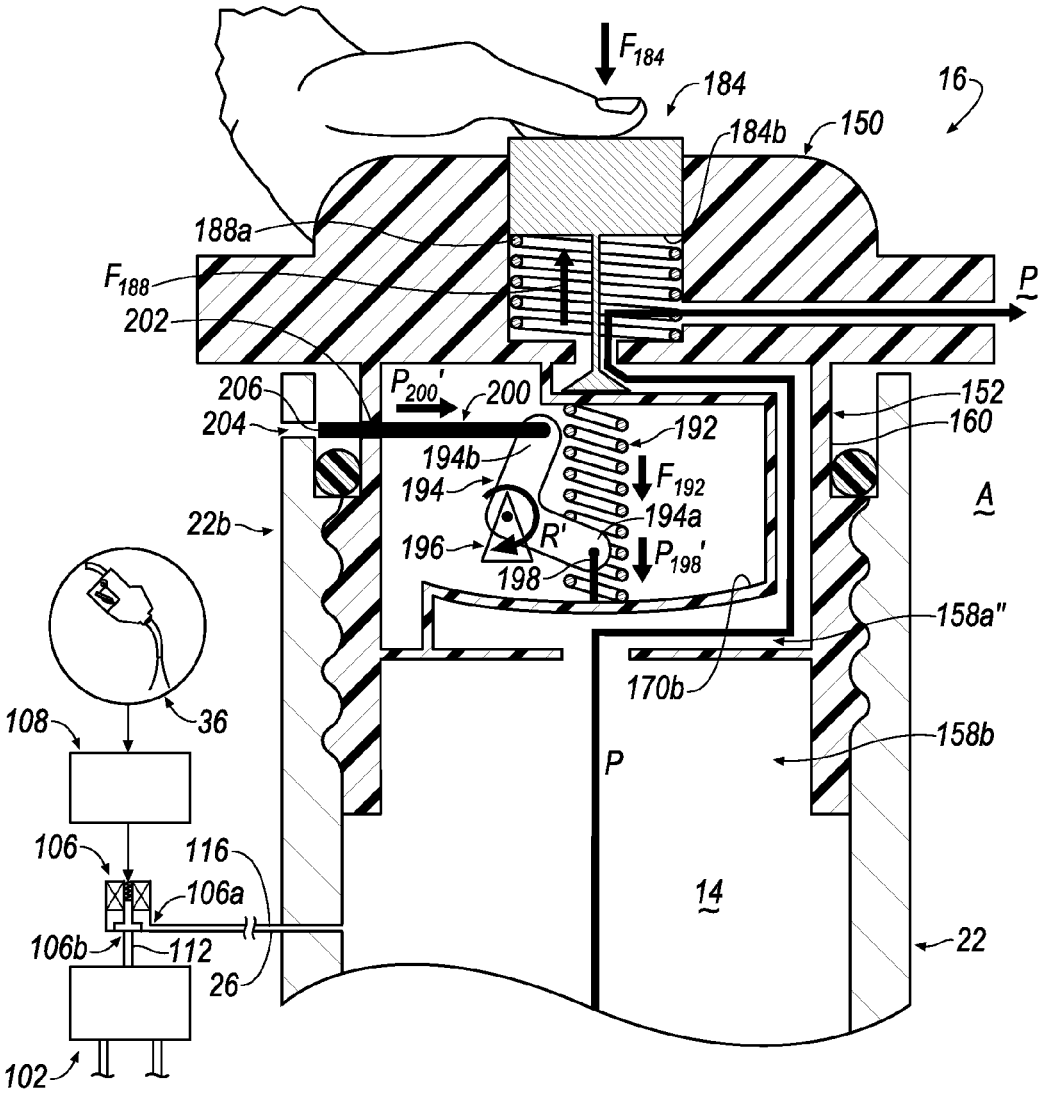
FIG. 6C is a view of the portion of the fuel system of FIG. 6B arranged in an unlocked orientation.

Referring now to FIGS. 6A-6C, after the fuel cap 16 is arranged in the locked orientation with the fuel depositing conduit 22 as described above in FIGS. 4A-4B, a method for returning the fuel cap 16 to an unlocked orientation with respect to the fuel depositing conduit 22 is described according to an embodiment. By unlocking the fuel cap 16, the user may mechanically decouple the fuel cap 16 from the fuel depositing conduit 22 (see, e.g., FIG. 5C) in order to, for example, deposit fuel, F, into the fuel tank 12 as seen, for example, in FIG. 2A.

As seen in FIGS. 1 and 6A, the user may locate a fuel cap unlocking button 36 that is associated with the fuel system 10. In some implementations, the fuel cap unlocking button 36 may be located upon the instrument panel 32 of the vehicle. Unlike the embodiment described above at FIGS. 5A-5B, in some circumstances, upon the user actuating (e.g., pressing) the fuel cap unlocking button 36, a malfunction, M (see FIG. 6A), may occur, which may, for example, prevent a signal to be may be communicated from the fuel cap unlocking button 36 to the control module 108 which would otherwise cause the vent valve 106 to be changed in orientation from a closed position (see FIGS. 5A, 6A) to an open position (see FIG. 5B) in order to fluidly-couple the fuel tank pressure-alleviating fluid conduit 26 with the canister 102. In such a circumstance, the user may have to access the user-actuated button 184 extending from the head portion 150 of the fuel cap 16 in order to unlock and decouple the fuel cap 16 from the fuel depositing conduit 22.

Referring to FIG. 6B, the user may apply a force, $F_{184}$, to the user-actuated button 184 in order to overcome a biasing force, $F_{188}$, applied to the lower end surface 184*b* of the user-actuated button 184 arising from the first, upper end 188*a* of the heavy relief spring 188 that is disposed adjacent the lower end surface 184*b* of the user-actuated button 184. As a result of the user-applied force, $F_{184}$, that overcomes the biasing force, $F_{188}$, arising from the heavy relief spring 188, the relief valve 186 is moved with user-actuated button 184, thereby moving the neck surface 186'" away from the inner surface 154 of the head portion 150 to thereby fluidly unseal the opening 174 to thereby permit the internal pressure, P, of the fuel tank 12 that is exposed to the fuel cap neck portion fluid conduit 158*a*" and the opening 14 defined by a fuel depositing conduit 22 to be exposed to atmospheric pressure, A, by way of the head portion fluid conduit 176.

Figure 6D:
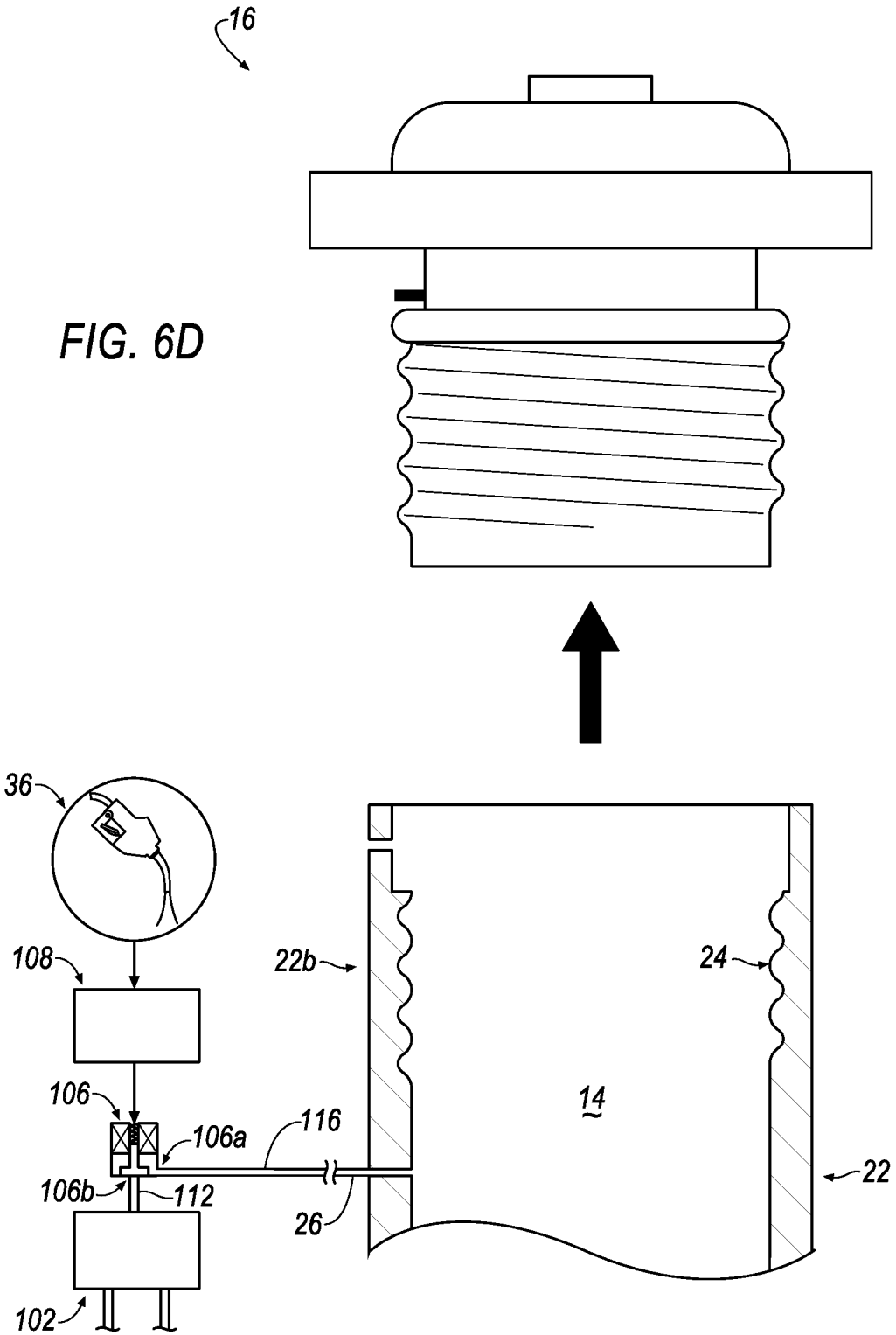
FIG. 6D is a view of the fuel cap of FIG. 6C detached from the portion of the fuel system.

By fluidly unsealing the opening 174 to thereby permit the internal pressure, P, to be exposed to atmospheric pressure, A, as described above, the internal pressure, P, of the fuel tank 12 may be reduced to thereby permit the biasing force, $F_{192}$, of the calibrated spring 192 to flex the flexible diaphragm 170*b* away from the head portion 150 of the fuel cap 16, which causes the flexible diaphragm 170*b* to pull, $P_{198}$' (opposite the arrow, $P_{198}$, of FIG. 4B), the linkage 198 connected to a first end 194*a* of the rocker arm 194, which causes the rocker arm 194 to rotate, R' (opposite the arrow, R, of FIG. 4B), about the pivot 196, which causes the second end 194*b* of the rocker arm 194 to retract, $P_{200}$' (opposite the arrow, $P_{200}$, of FIG. 4B), the locking pin 200 through the locking pin passage 202 formed by the neck portion 152 of the fuel cap 16 and away from the locking-pin-receiving passage 204 of the distal end 22*b* of the fuel depositing conduit 22 such that the distal end 206 of the locking pin 200 is no longer registered within the locking-pin-receiving passage 204 of the distal end 22*b* of the fuel depositing conduit 22 to thereby mechanically-decouple (see FIG. 6D)/mechanically unlock the fuel cap 16 from the distal end 22*b* of the fuel depositing conduit 22.

As used above, the terms "module," "control module" or "controller" may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The terms "module," "control module" or "controller" may include memory (shared, dedicated, or group) that stores code executed by the processor. The term "code," as used above, may include software, firmware, and/or microcode, and may refer to programs, routines, functions, classes, and/or objects. The term "shared," as used above, means that some or all code from multiple modules may be executed using a single (shared) processor. In addition, some or all code from multiple modules may be stored by a single (shared) memory. The term "group," as used above, means that some or all code from a single module may be executed using a group of processors. In addition, some or all code from a single module may be stored using a group of memories. The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A component of a fuel system, comprising:

a fuel cap including a head portion connected to a neck portion, wherein the head portion includes an inner surface and an outer surface, wherein the neck portion includes an inner surface and an outer surface, wherein the head portion defines:

a fluid pressure relief conduit that extends into the head portion from a first opening formed in the outer surface of the head portion, and a relief valve passage that extends into and through the head portion from a second opening formed in the outer surface of the head portion and terminates at a valve head opening formed by the inner surface of the head portion, wherein the relief valve passage intersects with and is in fluid communication with the fluid pressure relief conduit;

wherein the inner surface of the head portion and the inner surface of the neck portion cooperate to form a fuel cap cavity, wherein the fluid cap cavity is fluidly-connected to the fluid pressure relief conduit by way of the valve head opening formed by the inner surface of the head portion;

a relief valve movably arranged within the relief valve passage for permitting selective fluid communication of the fuel cap cavity with the fluid pressure relief conduit;

a locking apparatus arranged within the fuel cap cavity, wherein the locking apparatus includes a locking pin that extends through a locking pin passage formed by the neck portion of the fuel cap, wherein the locking pin extends through the locking pin passage from the inner surface of the neck portion and beyond the outer surface of the neck portion;

a support member connected to the inner surface of the neck portion and arranged within the fuel cap cavity, wherein the support member includes an upper surface and a lower surface; and a flange connected to the upper surface of the support member and the inner surface of the head portion, wherein the flange is connected to the locking apparatus.

2. The component of the fuel system of claim 1, further comprising:

a user-actuated button arranged within the first opening formed in the outer surface of the head portion, wherein a proximal end of the relieve valve is connected to a lower end surface of the user-actuated button; and a heavy relief spring arranged within the relief valve passage, wherein a first end of the heavy relief spring is disposed adjacent the lower end surface of the user-actuated button, wherein a second end of the heavy relief spring is disposed adjacent a ledge surface formed by the relief valve passage.

3. The component of the fuel system of claim 2, wherein a distal end of the relief valve is arranged within the valve head opening, wherein a portion of a neck surface of the relief valve extends slightly beyond the inner surface of the head portion, wherein a heavy relief spring biases the neck surface of the relief valve against the inner surface of the head portion for fluidly-sealing the valve head opening.

4. The component of the fuel system of claim 1, wherein the flange includes a plurality of segments, wherein a first rigid segment of the plurality of segments is connected to the upper surface of the support member, wherein a last rigid segment of the plurality of segments is connected to the inner surface of the head portion, wherein the plurality of segments includes a non-rigid, flexible diaphragm segment arranged between the first rigid segment and the last rigid segment, wherein the non-rigid, flexible diaphragm segment is connected to the locking apparatus.

5. The component of the fuel system of claim 4, wherein the locking apparatus includes a calibrated spring having a first end connected to the last rigid segment of the plurality of segments of the flange and a second end connected to the non-rigid, flexible diaphragm segment of the plurality of segments of the flange, wherein the calibrated spring imparts a biasing force toward the non-rigid, flexible diaphragm segment, a pivot connected to the inner surface of the neck portion, a rocker arm pivotably-connected to the pivot, a linkage connecting a first end of the rocker arm to the non-rigid, flexible diaphragm segment of the plurality of segments of the flange, and the locking pin connected to a second end of the rocker arm.

6. The component of the fuel system of claim 5, wherein the biasing force flexes the non-rigid, flexible diaphragm segment away from the inner surface of the head portion for causing the linkage to pull and thereby pivot the rocker arm about the pivot for pulling the locking pin through the locking pin passage and into the fuel cap cavity such that the locking pin is arranged in an unlocked orientation relative to the neck portion, wherein application of a force that is opposite to and greater than the biasing force flexes the non-rigid, flexible diaphragm segment toward the inner surface of the head portion for causing the linkage to push and thereby pivot the rocker arm about the pivot for pushing the locking pin through the locking pin passage and out of the fuel cap cavity such that the locking pin is arranged in a locked orientation relative to the neck portion.

7. The component of the fuel system of claim 1, wherein the outer surface of the neck portion defines an outer threaded surface portion that corresponds to an inner threaded surface portion of a fuel depositing conduit for threadingly-coupling the fuel cap to the fuel depositing conduit.

8. The component of the fuel system of claim 2, further comprising:

a seal ring arranged about the outer surface of the neck portion for sealing a fluid path between the outer threaded surface portion of the fuel cap and the inner threaded surface portion of the fuel line conduit when the fuel cap is threadingly-coupled to the fuel depositing conduit.

* * * * *